United States Patent [19]

Godijn

[11] Patent Number: 4,674,974

[45] Date of Patent: Jun. 23, 1987

[54] POT BURNER FOR LIQUID FUEL

[75] Inventor: Willem Godijn, Hilversum, Netherlands

[73] Assignee: Electrolux S.a.r.l., Vianden, Luxembourg

[21] Appl. No.: 845,271

[22] PCT Filed: Jun. 28, 1985

[86] PCT No.: PCT/EP85/00315

§ 371 Date: Feb. 25, 1986

§ 102(e) Date: Feb. 25, 1986

[87] PCT Pub. No.: WO86/00388

PCT Pub. Date: Jan. 16, 1986

[30] Foreign Application Priority Data

Jun. 29, 1984 [DE] Fed. Rep. of Germany ..... 3424069

[51] Int. Cl.[4] ..... F23D 5/02

[52] U.S. Cl. ..... 431/337; 431/339

[58] Field of Search ..... 431/337, 339

[56] References Cited

U.S. PATENT DOCUMENTS

| | | | |
|---|---|---|---|
| 2,513,551 | 7/1950 | Custance | 431/339 |
| 2,700,418 | 1/1955 | Gilmore | 431/339 |
| 4,466,790 | 8/1984 | Godijn | 431/337 |

*Primary Examiner*—Carroll B. Dority, Jr.

*Attorney, Agent, or Firm*—Kline, Rommel & Colbert

[57] ABSTRACT

A pot burner has a circularly cylindrical combustion space 10 with openings 60, 62, 64 in its wall for the supply of combustion air and with an inlet in its floor 32 for the liquid fuel. Concentrically in the combustion space 10 there is placed a first cage 28 with a smaller diameter and a second cage 42 with a larger diameter than the circular outlet 18 for the combustion gases. The first cage is shut off at the top by an upper cover wall 26 whereas the second cage 42 is shut off at the top by an annular outer part of the cover wall at a lower level. The second cage 42 is divided into an upper annular chamber 36 and a lower annular chamber 38 by a perforated ring 46. The floor 14 forming the bottom of the combustion space 10 is covered over by a shield 82 to prevent the floor 14 from being cooled by incoming cold air for combustion.

9 Claims, 3 Drawing Figures

POT BURNER FOR LIQUID FUEL

Figure 1:
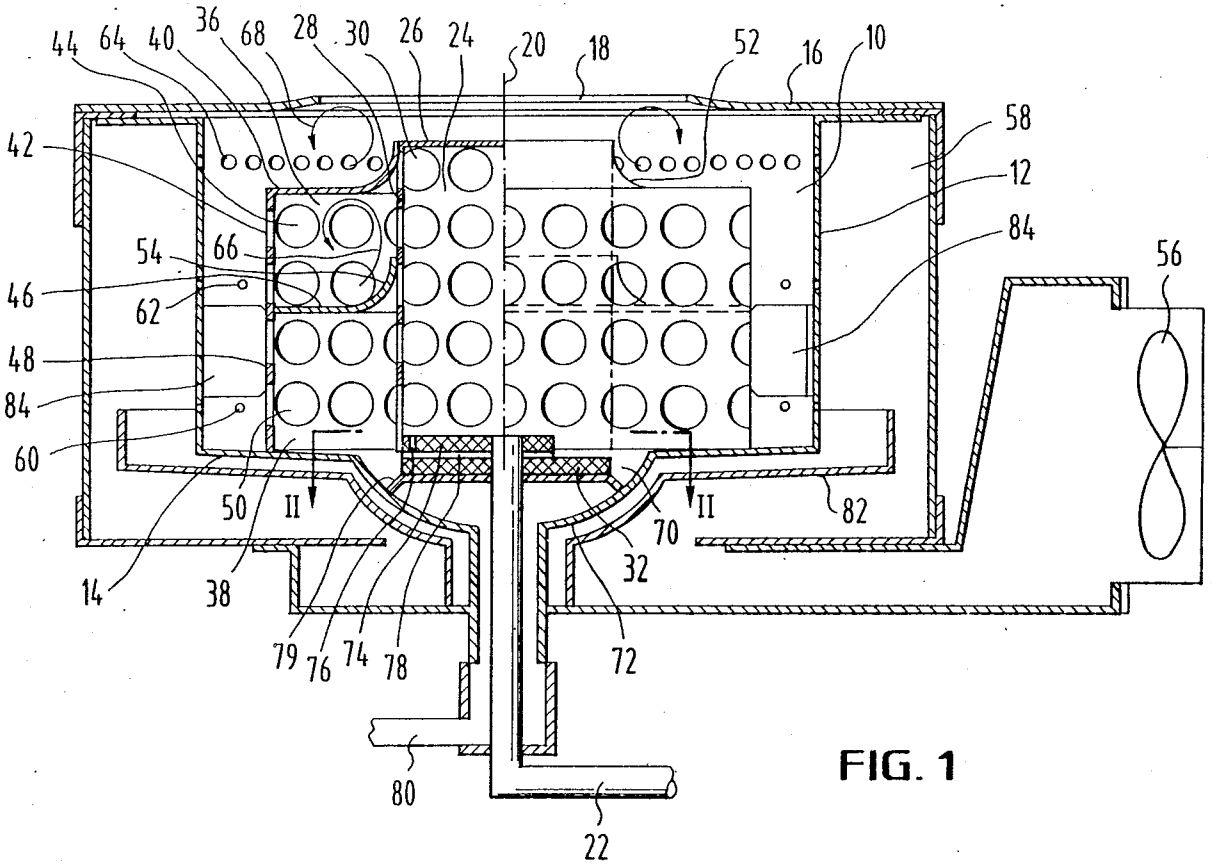

This invention relates to improvements in liquid-fuel pot burners.

Liquid-fuel pot burners, for example as shown in U.S. Pat. No. 4,466,790, usually include a row of holes at the outlet for the combustion gases to cause secondary air to flow radially towards the central axis of the combustion space for the final combustion of the fuel after evaporation thereof in the combustion space, on its way out of the burner.

Also, in previous liquid-fuel pot burners, the cover wall is placed at a substantial distance from the outlet and it is not possible to keep evaporated fuel from making its way through the outlet at the center thereof. It is difficult for the secondary air to reach this fuel so that unburned or incompletely burned fuel (CO=carbon monoxide) will be discharged from the burner, this naturally being undesired.

The object of the present invention is to design a burner in which the fuel is combusted as completely as possible.

This object is attained by the burner according to the invention with the characterizing features recited in the claims hereof.

It is a preferred characteristic of the present invention that the passage in which the secondary air impinges on the fuel becomes narrower, thus promoting the mixing of the fuel and the air and for this reason a more complete combustion. A further preferred characteristic is that the secondary air impinge on the surface forming the transition between the first and the second parts of the cover wall, producing turbulence in the entire annular outlet for fuel, such annular outlet being formed between the said transition and the edge of the circular outlet from the combustion space. The fuel has to pass through such turbulence and is there very effectively mixed with the secondary air, this again tending to promote complete combustion.

A preferred characteristic of the transition of my improved pot burner is to cause turbulence in the form of a ring which revolves about the center of its circular axis. The fuel, which is constrained to pass through this revolving ring, is very effectively mixed and burns consuming the secondary air in the ring.

The fuel that is evaporated in operation tends to rise upwards to a position under the cover wall, where it is deflected radially outwards. This impairs the mixing of the fuel with the primary air supplied through the openings that are spaced out along the height of the wall in the combustion space. It is also a preferred characteristic that the exit flow of fuel is distributed by the insert over the height thereof because of the collar on the ring. The primary air, which flows towards this collar, gives rise to turbulence between this ring and the second part of the cover wall. Such turbulence, that promotes the mixing of the fuel with the air, forms an obstacle for the fuel, which is attempting to make its way between the ring and the second part so that more fuel will tend to move out of the insert under the ring. I also preferably provide a plurality of cages to impart heat by radiation to the fuel, which flows through the insert, and may serve to produce a further improvement of the combustion.

The floor of the combustion space has to be maintained at a certain temperature to ensure that there is no undesired effect on the evaporation and combustion of the fuel in the combustion space. The outer side of the floor is thus preferably protected by a shield to keep the relatively cold combustion air from directly impinging on the floor and cooling it.

Figure 2:
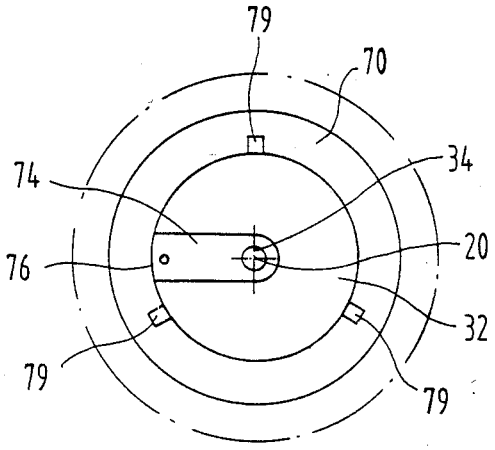
Figure 3:
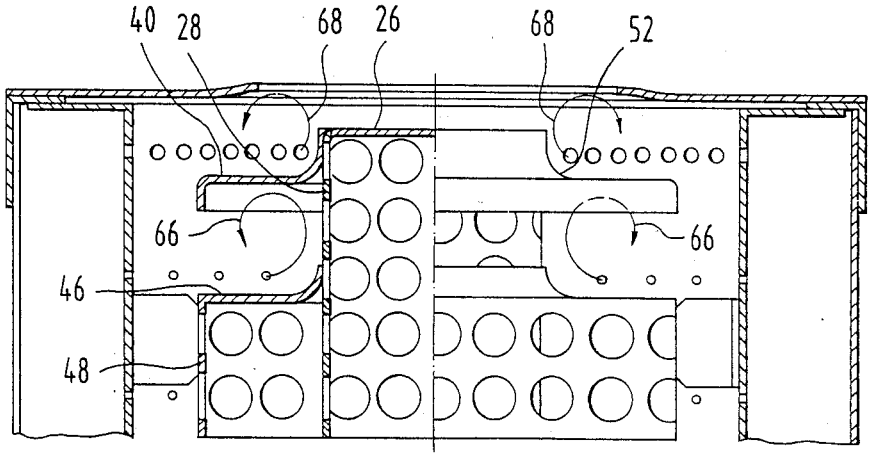

An embodiment will now be given of a burner in keeping with the invention on the basis of the attached drawing, in which:

FIG. 1 is a longitudinal section through a burner with a cage insert in the combustion space, such insert being partly sectioned and partly shown in elevation, FIG. 2 is a section taken on the line II—II of FIG. 1, and FIG. 3 is a view of a further possible form of the insert.

Turning to FIG. 1, 10 denotes a combustion space, which is enclosed by a circularly cylindrical wall 12, a floor 14 and an upper ring 16, which ring 16 has a circularly cylindrical opening 18 that is centered on the central axis 20 of the wall 12.

The fuel is supplied to the combustion space 10 through a pipe 22, which extends through the floor 14 and opens at the level of the lower edge of the wall 12 into chamber 24 within the space 10. At the top the chamber 24 is surrounded by a circular, imperforate disk-like part 26, at the sides by a circularly cylindrical cage 28 with openings 30, and from the bottom by a circular plate 32 of a porous material capable of absorbing fuel flowing over the edge of the openings 34 of the pipe 22.

The chamber 24 is surrounded by two further chambers: an upper annular chamber 36 and a lower annular chamber 38. The chamber 36 is surrounded at the top by an annular imperforate part 40 and at the sides by the cage 28 and by a cage 42 with openings 44, and from the bottom by an imperforate ring 46. The chamber 38 is walled off at the top by the ring 46, and at the sides by the cage 28 and a cage 48 with openings 50, and from the bottom by the floor 14. The part 40 has a rounded, imperforate part 52 adjoining part 26, said part 52 having in longitudinal section generally the form of a quadrant and adjoining the part 26 generally at a right angle. The ring 46 has a rounded, imperforate part 54 adjoining the cage 28, said part 54 having in longitudinal section the form of a quadrant.

A fan 56 propels combustion air into the space 10. The air from the fan firstly passes into a chamber 58 on the outer side of the wall 12. The wall is provided with a lower circle of openings 60, an intermediate circle of openings 62 and an upper circle of openings 64. The openings 60, 62, 64 direct air inwards in the form of jets radially towards the axis 20. The openings 50 of the cage 48 and the openings 30 of the cage 28 are aligned with the openings 60 so that the jets of air may make their way from the openings 60 into the chamber 24 without hinderance.

The openings 44 of the cage 42 are aligned with the openings 62 so that the jets of air may make their way unhindered from the openings 62 into the chamber 36. The ring 46 is placed at such level that the jets of air from the openings 62 flow towards its rounded part 54, which deflects the air jets in an upward direction towards to part 40 and further on in the direction marked by arrow 66 so that a swirling, turbulent gas curtain is formed between the part 40 and the ring 46. This gas curtain 66 extends like an annulus around the cage 28. The gas moves in the gas curtain 66 like a ring revolving about the center of its circular axis.

The air openings 64 are aligned with the rounded part 52. The part 26 is generally on the same level as the opening 18. The rounded parts 52 deflects the air jets from the openings 64 in an upward direction and then in the direction marked by the arrow 68, a further turbulent gas curtain so being formed between the part 52 and the ring 16. This gas curtain extends annularly around the part 52. In the gas curtain 68 the gas moves like a ring revolving about the center of its circular axis.

When the burner is being operated with its maximum heating effect, the fuel is evaporated by radiant heat from burning fuel in the chamber 24, by radiant heat from the inner cage 28, from the part 26 and from the plate 32 before passing over the opening 34. Jets of air coming from the openings 60 pass through the openings 50 and 30 and then into the chamber 24 so as to supply the necessary oxygen for combustion of a part of the gaseous fuel here. In the chamber 24 a mixture of completely burned fuel ($CO_2$), partly burned fuel (CO), unburned fuel and air is produced. Because it is heated such mixture tends to move upwards under the part 26 and then radially outwards to a position under the part 40. When the mixture is to flow out through the chamber 36, the gas curtain 66 forms an obstacle to the flow of the mixture so that some of the mixture makes its way through the chamber 38 under the ring 46. As a result distribution is improved and therefore there is a more complete combustion of the mixture which flows out through the cage 28.

The combustion of the fraction of the mixture that makes its way out of the chamber 36 is promoted by thorough admixture with further air in the gas curtain 66 and also by the radiation of heat from the cages 28 and 42, from the part 40 and from the ring 46.

The combustion of the part of the mixture that makes its way through the chamber 38 is promoted by the radiation of heat from the cages 28 and 48, from the ring 46 and from the floor 14. This fraction of the mixture also has to pass through the jets of air issuing from the openings 62 in the chamber between the wall 12 and the cage 42, something that also favors and promotes the combustion of the mixture. Lastly the mixture passes through the gas curtain 68. Here, further gas is supplied to the mixture. In the gas curtain 68 there is a thorough mixing of the air with the remaining flammable gas; at the same time as the mixture is exposed to radiation from the parts 40 and 52 and from the ring 16, it is practically completely burned so that the gas issuing from the opening 18 is practically completely burned.

The burner shown in part in FIG. 3 differs from the burner of FIG. 1 only inasfar as the cage 42 has been omitted. In some cases, in which the burner is made comparatively large in size, it has proved to be the case that the combustion is sufficient without the aid of radiated heat from the cage 42. FIG. 3 serves to illustrate such a case.

Fuel is supplied through the pipe 22 by a variable rate pump which is not shown. When the burner is operating with the maximum heat output, the pump is run at its maximum pumping rate. When the heat output of the burner is low, the burner is cooler and the fuel is not evaporated directly as it leaves the opening 34. The fuel is then absorbed or soaked up by the plate 32 and is distributed over a large area so that the evaporation of the fuel is facilitated. Irrespectively of the heating effect, every sort of fuel will normally be evaporated prior to reaching the periphery of the plate 32.

To prevent any fuel from flowing outwards beyond the outer limit of the plate 32 for any reason and thus outside the chamber 24, something which might lead to combustion being incomplete, such superfluous fuel is scavenged through an annular scavenging channel 70. The channel 70 is disposed between the periphery of the plate 32 and a conical, central part 72 in the floor 14, such conical part permitting the removal of superfluous fuel even when the burner is considerably inclined, something likely to be the case if the burner is used in a boat. The fuel that is collected by the conical part 72, is passed on through a scavenging duct 80 connected for example with a tank for supplying the burner with fuel.

In order to make it possible for the burner to be quickly started up, a strip 74 of porous, fuel-absorbing material is affixed to the plate 32. In comparison with the plate 32 the strip 74 has a small volume. The strip is placed about the opening 34 and extends to a position 76, where there is a device for igniting the fuel. Between the strip 74 and the plate 32 there is a thin piece 78 of sheet metal to keep fuel from the strip 74 absorbed by the strip 74 from the plate 32.

When the burner is started up the fuel pump is operated at maximum capacity. When the fuel issues from the opening 34, it is sucked up by the strip 74 and fuel flows at a fair rate to the igniting device 76 which ignites it. If there were no strip 74, ignition would take very much longer, since it would firstly be necessary for the entire plate 32 to become sodden with fuel before it reached the igniting device 76 at the periphery of the plate 32.

The plate is supported on the floor 14 by three legs 79 which provide for thermal insulation. For its part the floor 14 is screened off from the cold air, flowing into the chamber 58, by a shield 82 for thermal insulation. The entire insert in the combustion space consisting of the parts 26, 52, and 40, the cages 28, 42, and 48, and the ring 46, is supported on the floor 14 and is centered and supported in the burner by radial arms 84.

Herein the term secondary air is used in the sense of air that is supplied to the combustion space for ultimate combustion of the fuel mixture, while the term primary air is used in the sense of air supplied to the combustion space for partial combustion of the fuel mixture prior to ultimate combustion with secondary air.

The insert, consisting of the parts 26, 52, 40, 28, 42, 48 and 46 and the ring 16 together with the floor 14 are made of a material, as for example sheet steel, which freely radiates heat when the same is heated.

I claim:

1. A burner for liquid fuel comprising a substantially circularly cylindrical combustion space (10), an inlet (34) at one end of said space for the supply of fuel into such space, openings (60, 62, 64) in the cylindrical wall of the said space for the supply of combustion air into said space, an outlet at the other end of said space for combustin gases, said outlet consisting of a circular opening (18) having a diameter smaller than said space and being concentric thereto, and an insert in said space in the form of a cage (28) with perforated sides extending from one end to the other of said space and terminating in an imperforate circular cover wall (40, 52, 26), same being concentric to said space, characterized in that the cover wall has a centrally circular, first part (26), which is located on a first level generally the same as the level of the outlet (18) and has a diameter smaller than that of the outlet, in that the cover wall has an annular second part (40), which is located at a second level under the first said level and has an outer diameter, that is large than the diameter of the outlet, in that openings (64) for combustion air are placed in the cylindrical wall (12) of the space at a level between the first and the second level in order to cause combustion air to flow radially towards the surface (52) of the cover wall, said surface forming the transition between the first (26) and the second part (40) of the cover wall.

2. The burner as claimed in claim 1, characterized in that the transition (52) has a longitudinal section substantially in the form of a quadrant, whose one end is substantially parallel to the second part (40) and whose second end is substantially at a right angle to the first part (26).

3. The burner as claimed in either of claims 1 or 2, in which fuel is supplied to a position (34) which is central and at one end of the space, characterized in that a first circularly cylindrical cage (28), whose one end is flush with the periphery of the first part (26), extends generally to the level of the inlet (34), and the cage (28) is surrounded at a level between the cover wall and the inlet by a ring (46), which is substantially parallel to the other part (40) and is flush with the cage (28) with a collar (54), which forms a round transition between the ring (46) and the cage (28) and is directed towards the periphery of the first part (26).

4. The burner as claimed in claim 3, characterized in that a second circularly cylindrical cage (48) is provided, whose one end is flush with the periphery of the ring (46) and which extends generally as far as the level of the inlet (34).

5. The burner as claimed in claim 4, characterized by a third circularly cylindrical cage (42), whose one end is flush with the periphery of the second part (40) and whose other end is flush with the periphery of the ring (46).

6. The burner as claimed in either of claims 1 or 2, in which the one end of the space is made of a thermally conducting floor (14, 72), characterized by a shield (82) placed outside the floor, said shield preventing combustion air, which flows into the burner, from cooling the floor.

7. The burner as claimed in claim 6 in which fuel is supplied to a position (34) which is central and at one end of the space, characterized in that said cylindrical cage (28), whose one end is flush with the periphery of the first part (26), extends generally to the level of the inlet (34), and the cage (28) is surrounded at a level between the cover wall and the inlet by a ring (46), which is substantially parallel to the second part (40) and is flush with the cage (28) with a collar (54), which forms a round transition between the ring (46) and the cage (28) and is directed towards the periphery of the first part (26).

8. The burner as claimed in claim 7, characterized in that a second circularly cylindrical cage (48) is provided, whose one end is flush with the periphery of the ring (46) and which extends generally as far as the level of the inlet (34).

9. The burner as claimed in claim 8, characterized by a third circularly cylindrical cage (42), whose one end is flush with the periphery of the second part (40) and whose other end is flush with the periphery of the ring (46).

* * * * *